US008275136B2

(12) United States Patent
Niemisto et al.

(10) Patent No.: US 8,275,136 B2
(45) Date of Patent: Sep. 25, 2012

(54) ELECTRONIC DEVICE SPEECH ENHANCEMENT

(75) Inventors: Riitta Elina Niemisto, Tampere (FI); Jukka Petteri Vartiainen, Tampere (FI)

(73) Assignee: Nokia Corporation, Espoo (FI)

( * ) Notice: Subject to any disclaimer, the term of this patent is extended or adjusted under 35 U.S.C. 154(b) by 632 days.

(21) Appl. No.: 12/429,785

(22) Filed: Apr. 24, 2009

(65) Prior Publication Data

US 2009/0316918 A1 Dec. 24, 2009

Related U.S. Application Data

(60) Provisional application No. 61/125,475, filed on Apr. 25, 2008, provisional application No. 61/125,470, filed on Apr. 25, 2008.

(51) Int. Cl.
*H04R 29/00* (2006.01)

(52) U.S. Cl. ..... 381/58

(58) Field of Classification Search ..... 381/58–60
See application file for complete search history.

(56) References Cited

U.S. PATENT DOCUMENTS

| | | | |
|---|---|---|---|
| 5,123,887 | A | 6/1992 | Shimura |
| 5,242,364 | A | 9/1993 | Lehmann |
| 5,276,765 | A | 1/1994 | Freeman et al. |
| 5,383,392 | A | 1/1995 | Kowalewski et al. |
| 5,459,814 | A | 10/1995 | Gupta et al. |
| 5,657,422 | A | 8/1997 | Janiszewski et al. |
| 5,687,241 | A | 11/1997 | Ludvigsen |
| 5,749,067 | A | 5/1998 | Barrett |
| 5,793,642 | A | 8/1998 | Frisch et al. |
| 5,822,718 | A | 10/1998 | Bakis et al. |
| 5,963,901 | A | 10/1999 | Vahatalo et al. |
| 6,023,674 | A | 2/2000 | Mekuria |
| 6,182,035 | B1 | 1/2001 | Mekuria |
| 6,427,134 | B1 | 7/2002 | Garner et al. |
| 6,449,593 | B1 | 9/2002 | Valve |
| 6,556,967 | B1 | 4/2003 | Nelson et al. |

(Continued)

FOREIGN PATENT DOCUMENTS

EP 0335521 10/1989

(Continued)

OTHER PUBLICATIONS

Hoffman, Michael W., et al., "GSC-Based Spatial Voice Activity Detection for Enhanced Speech Coding in the Presence of Competing Speech", IEEE Transactions on Speech and Audio Processing, vol. 9, No. 2, Mar. 2001, pp. 175-179.

(Continued)

*Primary Examiner* — Benjamin Sandvik
*Assistant Examiner* — Whitney T Moore
(74) *Attorney, Agent, or Firm* — Harrington & Smith

(57) ABSTRACT

Disclosed herein is an apparatus. The apparatus includes a first audio input device, a second audio input device, an analog to digital converter, a voice activity detector, and a position detector. The first audio input device is configured to receive a first audio signal. The second audio input device is configured to receive a second audio signal. The analog to digital converter is connected to the first and the second audio input devices. The voice activity detector is connected to the analog to digital converter. The voice activity detector is configured to receive input from the first and the second audio input devices. The position detector is connected to the voice activity detector. The position detector is configured to determine a position of the apparatus and classify the audio signals based on, at least partially, a ratio of the first audio signal and the second audio signal.

19 Claims, 4 Drawing Sheets

U.S. PATENT DOCUMENTS

| | | | |
|---|---|---|---|
| 6,574,592 | B1 | 6/2003 | Nankawa et al. |
| 6,647,365 | B1 | 11/2003 | Faller |
| 6,675,125 | B2 | 1/2004 | Bizjak |
| 6,810,273 | B1 | 10/2004 | Mattila et al. |
| 7,203,323 | B2 | 4/2007 | Tashev |
| 2001/0056291 | A1 | 12/2001 | Zilberman et al. |
| 2002/0103636 | A1 | 8/2002 | Tucker et al. |
| 2002/0138254 | A1 | 9/2002 | Isaka et al. |
| 2003/0228023 | A1 | 12/2003 | Burnett et al. |
| 2004/0042626 | A1 | 3/2004 | Balan et al. |
| 2004/0117176 | A1 | 6/2004 | Kandhadai et al. |
| 2004/0122667 | A1 | 6/2004 | Lee et al. |
| 2005/0108004 | A1 | 5/2005 | Otani et al. |
| 2005/0147258 | A1 | 7/2005 | Myllyla et al. |
| 2006/0053007 | A1 | 3/2006 | Niemisto |
| 2007/0136053 | A1 | 6/2007 | Ebenezer |
| 2008/0199024 | A1 | 8/2008 | Nakadai et al. |
| 2008/0317259 | A1 | 12/2008 | Zhang et al. |
| 2009/0089053 | A1 | 4/2009 | Wang et al. |

FOREIGN PATENT DOCUMENTS

| | | | |
|---|---|---|---|
| EP | 0734012 | A2 | 9/1996 |
| EP | 1453349 | A2 | 9/2004 |
| WO | 01/37265 | A1 | 5/2001 |
| WO | 2007013525 | | 2/2007 |
| WO | 2007/138503 | A1 | 12/2007 |

OTHER PUBLICATIONS

Widrow, Bernard, "Adaptive Noise Cancelling: Principles and Applications", Proceedings of the IEEE, vol. 63, No. 12, Dec. 1975, pp. 1692-1716.

Gazor, et al., "A soft voice activity detector based on a Laplacian-Gaussian model", IEEE Transaction Speech and Audio Processing, vol. 11, No. 5, Sep. 2003, 498-505 pages.

Marzinzik, et al., "Speech pause detection for noise spectrum estimation by tracking power envelope dynamics", IEEE Transaction Speech and Audio Processing, vol. 10, No. 2, Feb. 2002, 109-118 pages.

Teutsch, et al. "An Adaptive Close-Talking Microphone Array", New Paltz, New York, Oct. 21-24, 2001, 4 Pages.

Hua, et al. "A new self-calibration technique for adaptive microphone arrays", Media and Information Research Laboratories, NEC Corporation, Kawasaki 211-8666, Japan, 4 Pages.

Ivan Tashev, "Gain Self-Calibration Procedure for Microphone Arrays", Microsoft Research, One Microsoft Way, Redmond, WA 98052, USA, 4 Pages.

Buck, et al., "Self-calibrating microphone arrays for speech signal acquisition: a systematic approach", vol. 86 , Issue 6, Jun. 2006, 1230-1238 pages.

Hansler, et al., Acoustic echo and noise control: A Practical Approach, John Wiley & Sons, Inc. Hoboken, New Jersey, 2004.

International Search Report and Written Opinion received in corresponding PCT Application No. PCT/IB2009/005374, dated, Aug. 12, 2009, 14 pages.

Office Action received in related U.S. Appl. No. 12/109,861, dated May 5, 2011, 7 pages.

International Search Report and Written Opinion received in corresponding PCT Application No. PCT/FI2009/050314 dated Sep. 3, 2009, 10 pages.

File history for related (abandoned) U.S. Appl. No. 11/214,454, filed Aug. 29, 2005, 200 pages.

Zhibo Cai, et al., "A knowledge based real-time speech detector for microphone array video conferencing system" Signal Processing, 2002 6th International Conference on Aug. 26-30, 2002, Piscataway, New Jersey, USA, IEEE, vol. 1, pp. 350-353.

Furui, et al., Advances in Speech signal processing, Newyork: Marcel Dekker, 1992.

Gray, Jr., et al, "A spectral-flatness measure for studying the auto correlation method of linear prediction of speech analysis", IEEE Transaction Acoustics, Speech, Signal Processing, vol. ASSP-22, Jun. 1974, 207-216 pages.

Prasad et al., "Comparison of Voice Activity Detection Algorithms for VoIP", Proceedings of the 7th International Symposium on Computers and Communications, dated Jul. 1-4, 2002, pp. 530-535.

International Search Report and Written Opinion received in corresponding PCT Application No. PCT/FI2009/050302 dated Nov. 21, 2005, 11 pages.

"Mandatory Speech Codec speech processing functions AMR speech codec" Voice Activity Detector (VAD), Technical Specification Group Services and System Aspects; 3rd Generation Partnership Project; 3G TS 26.094 version 3.0.0, date Oct. 1999, 29 Pages.

Extended European Search Report received for corresponding European Patent Application No. 05775189.3, dated Nov. 3, 2008, 7 Pages.

ELECTRONIC DEVICE SPEECH ENHANCEMENT

CROSS REFERENCE TO RELATED APPLICATION

This application claims priority under 35 U.S.C. §119(e) to U.S. provisional patent application No. 61/125,470 filed Apr. 25, 2008, and U.S. provisional patent application No. 61/125,475 filed Apr. 25, 2008, which are hereby incorporated by reference in their entireties.

BACKGROUND

1. Field of the Invention

The invention relates to an electronic device and, more particularly, to speech enhancement for an electronic device.

2. Brief Description of Prior Developments

Speech enhancement using voice activity detectors are known in the art. For example, voice activity may be detected in the context of GSM and WCDMA telecommunication systems wherein the signal and noise power may be estimated in different frequency bands. Some configurations may utilize one microphone or an array of microphones for noise suppression and spatial voice activity detection (SVAD). Additionally, some configurations may utilize various methods to suppress noise in a signal in a communications path between a cellular communications network and a mobile terminal. Other configurations may also detect voice activity in a speech signal using digital data formed on the basis of samples of an audio signal.

However, despite the above mentioned configurations, there is still a need in the art for improving the quality of speech and/or audio signal used as input in an electronic device.

SUMMARY

The foregoing and other problems are overcome, and other advantages are realized, by the use of the exemplary embodiments of the invention.

In accordance with one aspect of the invention, an apparatus is disclosed. The apparatus includes a first audio input device, a second audio input device, an analog to digital converter, a voice activity detector, and a position detector. The first audio input device is configured to receive a first audio signal. The second audio input device is configured to receive a second audio signal. The analog to digital converter is connected to the first and the second audio input devices. The voice activity detector is connected to the analog to digital converter. The voice activity detector is configured to receive input from the first and the second audio input devices. The position detector is connected to the voice activity detector. The position detector is configured to determine a position of the apparatus and classify the audio signals based on, at least partially, a ratio of the first audio signal and the second audio signal.

In accordance with another aspect of the invention, a method is disclosed. A first audio signal is received. A second audio signal is received. The first and the second audio signals are filtered. A ratio of the first and the second audio signals is calculated. A position of a device is determined. The audio signals are classified based on the calculated ratio and the determined position of the device.

In accordance with another aspect of the invention, a method is disclosed. At least two audio signals are received. One of the at least two audio signals is received at a first microphone. Another one of the at least two audio signals is received at a second microphone. A ratio of the at least two audio signals is determined. A position of a device is determined based on the determined ratio. A speech processor of the device is switched from a two microphone processing mode to a one microphone processing mode based on, at least partially, the determined position of the device.

In accordance with another aspect of the invention, a program storage device readable by a machine, tangibly embodying a program of instructions executable by the machine for performing operations to process audio speech signals is disclosed. A first audio signal is received. A second audio signal is received. The first and the second audio signals are filtered. A ratio of the first and the second audio signals is calculated. A position of a portable device is determined. The audio signals are classified based on the calculated ratio and the determined position of the portable device.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
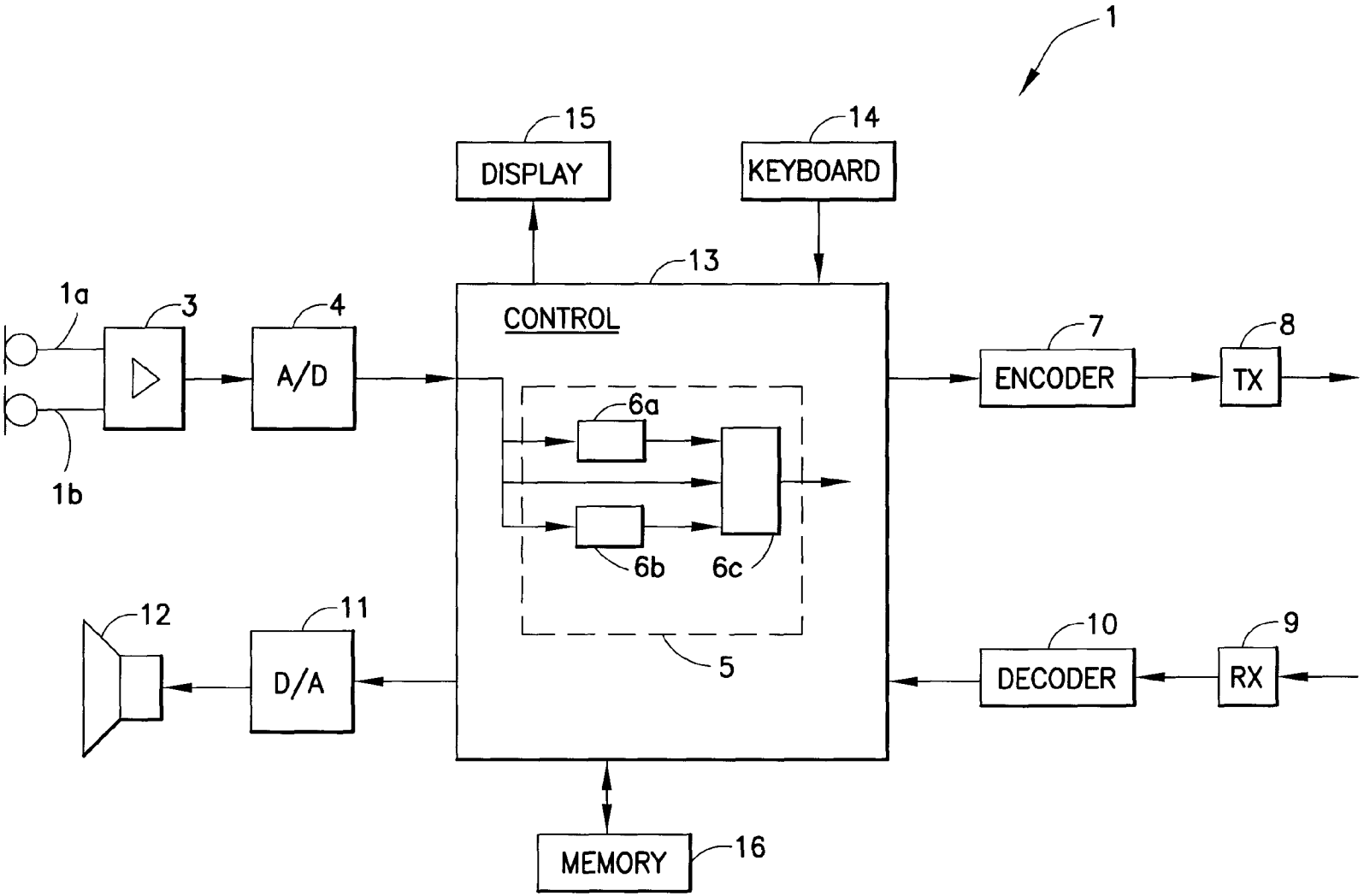
FIG. 1 is a schematic drawing of an electronic device incorporating features of the invention.

Referring to FIG. 1, there is shown an exemplary electronic device 1 incorporating features of the invention. Although the invention will be described with reference to the exemplary embodiments shown in the drawings, it should be understood that the invention may be embodied in many alternate forms of embodiments. In addition, any suitable size, shape or type of elements or materials could be used.

In this example embodiment the electronic device 1 may be a wireless communication device, but it should be understood that the various embodiments of the invention are not restricted to wireless communication devices only. Various examples of the invention may be implemented in the desktop or laptop computers, for example. Additionally, features according to various exemplary embodiments of the invention could be used in any suitable type of hand-held portable electronic device such as a mobile phone, a gaming device, a music player, or a PDA, for example. Further, as is known in the art, the device 1 may include multiple features or applications such as a camera, a music player, a game player, or an Internet browser, for example. The electronic device 1 comprises at two audio input microphones 1*a*, 1*b* for inputting an audio signal for processing. The audio signal may be amplified, by amplifier 3 and noise suppression may also be performed to produce an enhanced audio signal. The audio signal is divided into speech frames which means that a certain length of the audio signal is processed at one time. The length of the frame is usually a few milliseconds, for example 10 ms or 20 ms. The audio signal may also be digitised in an analog/digital converter 4. The analog/digital converter 4 forms samples from the audio signal at certain intervals for example, at a certain sampling rate. After the analog/digital conversion, a speech frame may be represented by a set of samples. The electronic device 1 may also have a speech processor 5 in which the audio signal processing can be at least partly performed. The speech processor 5 may be, for example, a digital signal processor (DSP). The speech processor may also perform other operations, such as echo control in the uplink (transmission) and/or downlink (reception) of a wireless communication channel.

The device 1 of FIG. 1 may also comprise a control block 13, in which the speech processor 5 and other controlling operations may be implemented, a keyboard 14, a display 15, and electronic circuitry, such as a memory 16, for example.

The samples of the audio signal may be input to the speech processor 5. In the speech processor 5 the samples can be processed on a frame-by-frame basis. The processing may be performed in the time domain, or in the frequency domain or in both domains.

The position detector 6*a* and the spatial voice activity detector 6*b*, according to examples of the invention, may examine the speech samples to give an indication whether the samples of the current frame contain a speech or a non-speech signal. The indication from the detectors 6*a* and 6*b* may be input to a third detector 6*c* to make a final voice activity decision. The role of the position detector 6*a* may be, for example, to decide if spatial VAD can be trusted or not. If the phone 1 is held differently than a design/orientation assumed by a beamformer, in the post processing stage only single channel methods may used for VAD. Additionally, there may be a third input to 6*c*, which may be the signals coming from the analog/digital converter 4 that may be used for single channel VAD, for example. Several operations within the electrical device may then utilise the voice activity decision. For example, a noise cancellation circuit may estimate and update a spectrum of the noise when the voice activity decision indicates that the signal does not contain speech. It should be noted that although the position detector 6*a* may be described in connection with the spatial voice activity detector 6*b*, various exemplary embodiments of the invention may be provided without the spatial voice activity detector 6*b*. Additionally, any suitable detector configuration may be provided. Further, although the position detector 6*a* may be described as utilizing input from two microphones, embodiments of the invention may provide for the position detector 6*a* to utilize input from more than two microphones.

The position detector 6*a* ensures that two-microphone processing may be at least as good as single channel processing with one microphone. If the device, or phone, 1 is held in some odd manner (for example, a bottom of the phone pointing to a user's nose rather than to a user's mouth) two-microphone processing assuming optimal positioning could attenuate the user's own voice. Utilizing position detection, it may be possible to switch the phone to one-microphone processing, for example. In another non-limiting example, two-microphone processing may be provided even if the phone position is in an odd manner/orientation.

The device 1 may also comprise an audio/speech encoder (source encoding) 7 to encode the speech for transmission. The encoded speech may be channel coded and transmitted by a transmitter 8 via a communication channel, for example a mobile communication network, to another electronic device such as a wireless communication device. The transmission chain may further comprise channel coding (not shown in FIG. 1). However, any suitable transmission chain may be provided.

In the receiving part of the electronic device 1, there may also be provided a receiver 9 for receiving signals from the communication channel. The receiver 9 performs channel decoding and directs the channel decoded signals to a decoder 10 which reconstructs the speech frames. The speech frames and noise are converted to analog signals by a digital to analog converter 11. The analog signals may be converted to audible signal by a loudspeaker or an earpiece 12.

It may be assumed that a sampling frequency of 8 kHz is used in the analog to digital converter wherein the useful frequency range is about from 0 to 4 kHz which usually is enough for speech. It may also possible to use sampling frequencies other than 8 kHz, for example 16 kHz when also higher frequencies than 4 kHz could exist in the signal to be converted into digital form. However, any suitable sampling frequency may be utilized.

Figure 2:
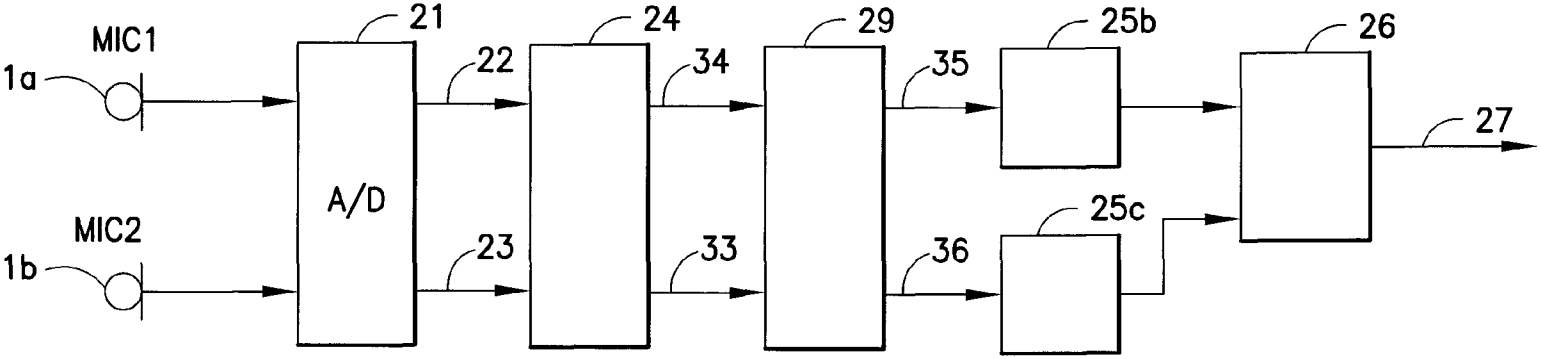
FIG. 2 is a schematic drawing illustrating another embodiment of the invention used in the device shown in FIG. 1.

As shown in FIG. 1, the device 1 may be configured to provide the amplifier 3 between the microphones 1*a*, 1*b* and the analog to digital converter 4. However, other suitable configurations may be provided. For example, according to another example embodiment of the invention, the audio signals from the microphones 1*a*, 1*b* may be input to the analog to digital converter without an amplifier (see FIG. 2). FIG. 2 shows in more detail, the operation and configuration between the analog to digital converter and the position detector according to some examples of the invention. For example, a filtering function 24, a stereo beam former 29, and power estimation units 25*b*, 25*c* may be provided between the analog to digital converter 21 and the position detector 26. It should be understood that although these components are described with reference to FIG. 2, the filtering function 24, the stereo beam former 29, and the power estimation units 25*b*, 25*c* may be provided between the analog to digital converter 4 and the position detector 6*a* in FIG. 1. However, any suitable configuration may be provided.

After the conversion into digital form (A/D conversion 21) the audio signals 22, 23 are directed to the filtering function 24, where the audio signals may be filtered.

According to some embodiments of the invention, the filtering function 24 may be provided to retain only those frequencies in the signals where the position detector operation is most effective. In one embodiment of the invention, a low-pass filter may be used. The low-pass filter may have a cut-off frequency for example, at about 1 kHz to pass frequencies below that (for example, about 0-1 kHz). Depending on the microphone configuration some other filter (for example, band-pass filter about 1-3 kHz) may be used. However, any suitable filter configuration may be provided.

Filtered signals 33, 34 may then be input to the stereo beam former 29. Signals 35, 36 from the stereo beam former 29 may then be input to the power estimation units 25*b*, 25*c*. The output signal 27 from the position detector 26 may a binary value (1/0) for optimal/off-axis indication as described below in more detail. However, any suitable output signal may be provided.

In one embodiment of the invention, the filtering function 24 locates after the stereo beam former 29. In this example embodiment, the audio signals 22, 23 originating from the first and the second microphones and the main and anti beam signals 35 and 36 may be filtered before inputted to the power estimation units 25*b*, 25*c* (and to be used in the position detector 26). However, any suitable configuration may be provided.

Figure 3:
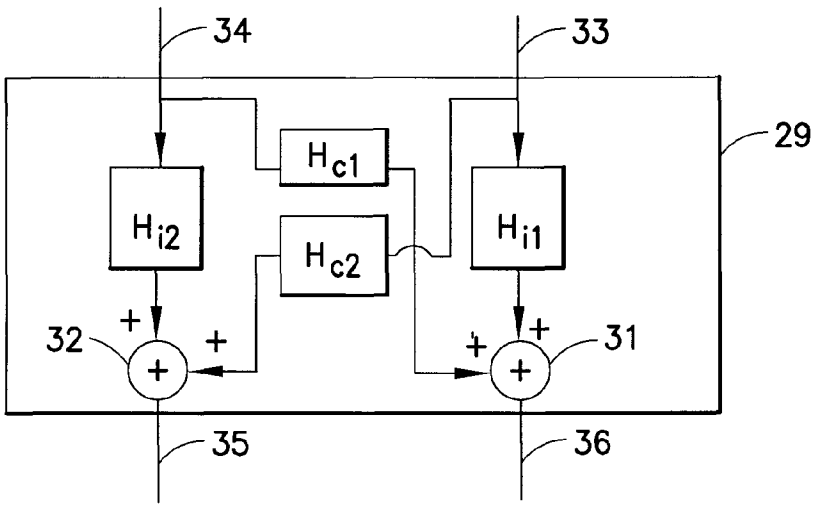
FIG. 3 is a schematic drawing of a stereo beam former used in the device shown in FIG. 1.

FIG. 3 shows the operation of the stereo beam former 29 in more detail. The beam former 29 has a summation element 31 for receiving the first audio signal 34 processed by the transfer function Hc1 and second audio signal 33 processed by the transfer function Hi1. Similarly, a summation element 32 receives the first audio signal 34 processed by the transfer function Hi2 and second audio signal 33 processed by the transfer function Hc2. The output signals from the summation elements 31, 32 may be the main beam signal 35 and anti beam signal 36 which are directed to the power estimation units (25*b*, 25*c* in FIG. 2) and then used in the position detector 26. The transfer functions Hi1, Hi2, Hc1 and Hc2 may be designed/configured so that the main beam and anti beam signals 35, 36 correspond to beams of $1^{st}$ order directional microphones. The transfer functions Hi1, Hi2 may be identical or different transfer functions. Similarly Hc1 and Hc2 may be identical or different functions. When the transfer functions are identical, both the main and anti beams may have a similar beam shape. Having different transfer functions enables to have different beam shapes for the main beam and anti beam. When two microphones are used, the sensitivity of the microphones may be described with the formula:

$$R(\theta)=(1-K)+K*\cos(\theta) \quad (1)$$

Where R is the sensitivity, for example, the magnitude response in the function of the speech signal angle θ. K is a parameter describing the microphone types:

K=0, omni directional

K=½, cardioid

K=⅔, hypercardiod

K=¾, supercardiod

K=1, bidirectional

In other words the beam former 29 may provide two beams, for example, main beam and anti beam signals 35, 36 with opposite directional patters (K may thus be for example about ½).

Returning to FIG. 2, the position detector 26 may classify between voice and noise based on a main-beam 35—anti-beam 36 ratio.

For example, let $b_1$ and $b_2$ refer to estimated mainbeam and antibeam signal powers, respectively. If the ratio $b_1/b_2$ is very high, the phone is positioned correctly, if the ratio is moderate the phone is positioned incorrectly, and if it is very low (close to one) there is no local speech present at all.

The position detector 26 may be implemented by using several thresholds to decide when the ratio is high, moderate or low. Moreover, several counters may be used so that the position detector keeps its value for several seconds. Finally, a rough estimate of a background noise level may be estimated.

According one embodiment of the invention, the position detector 26 may change its value from optimal to off-axis, or from off-axis back to optimal.

The position detector 26 may change its value from optimal to off-axis when the ratio $b_1/b_2$ has not been very low for about 2.5 seconds, for example. However, any suitable time frame may be provided. The position detector 26 may also change its value from optimal to off-axis when the ratio has been between two thresholds that indicate moderate considerably more often than above another threshold that indicates high level. The position detector 26 may also change its value from optimal to off-axis when the signal level is considerably higher than the estimated background noise level (indicating speech presence).

The position detector 26 may change its value from off-axis back to optimal when the ratio has been more often very high (above certain threshold) considerably more often than moderate (between the other two thresholds).

It should be noted these are merely non-limiting examples for value changes in the position detector and that any suitable conditions may be provided for the position detector to change its value.

The thresholds concerning when the ratio $b_1/b_2$ is high, moderate or low may depend on the positioning of the microphones and the design of the beam-former. Moreover, the thresholds may depend on the estimated background noise level.

Figure 4:
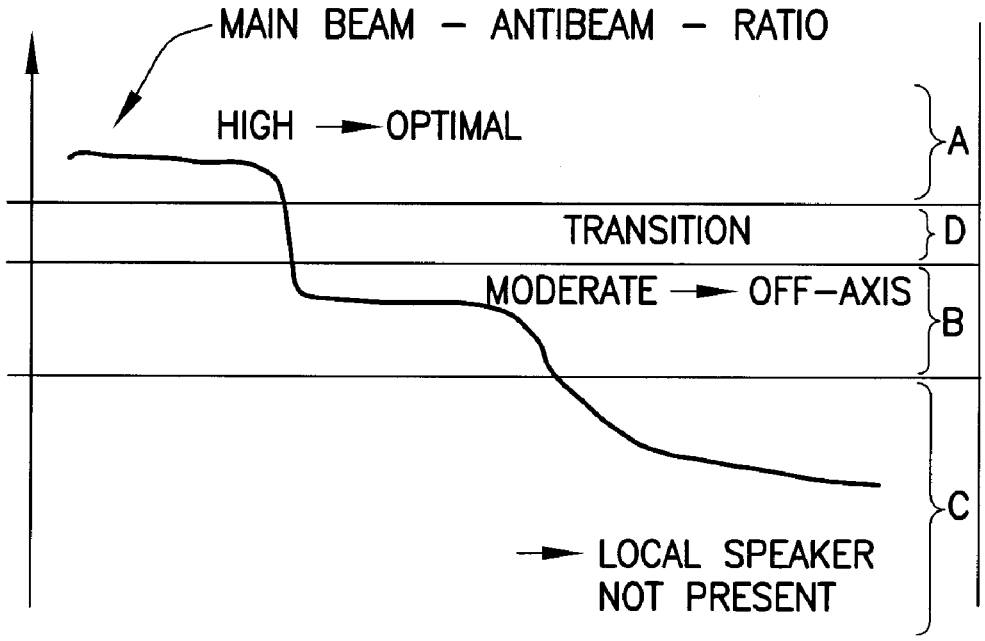
FIG. 4 is a graphical illustration of ratio thresholds/zones used in the device shown in FIG. 1.

FIG. 4 also depicts an exemplary graphical illustration of the basic functioning of the position detector 26 as described above. For example, ratios in graphical zone A may be a high ratio indicating an optimal position/orientation of the device 1. Ratios in graphical zone B may be a moderate ratio indicating an off-axis position/orientation of the device 1. Ratios in graphical zone C may be a low ratio indicating that the local speaker/user is not present (and therefore may be disregarded). Ratios in graphical zone D may indicate a transition between zones A and B (and therefore may be disregarded). It should be noted that although FIG. 4 illustrates four graphical zones, any suitable number of graphical zones may be provided.

As described above, position detection may be computed using powers of two signals: main beam signal and anti beam signal. A position detector decision may then be computed, as described above using smoothed powers of these filtered signals.

According to one embodiment, the position detector 26 may be used for deciding if spatial VAD can be trusted or not. However, this may be provided as a non-limiting example, and the position detector may be used for other suitable purposes as well. It should be noted that although the position detector 26 may be described in connection with the spatial VAD, various exemplary embodiments of the invention may be provided without the spatial VAD. Additionally, any suitable detector configuration may be provided. Further, although the position detector 26 may be described as utilizing input from two microphones, embodiments of the invention may provide for the position detector 26 to utilize input from more than two microphones.

Figure 5:
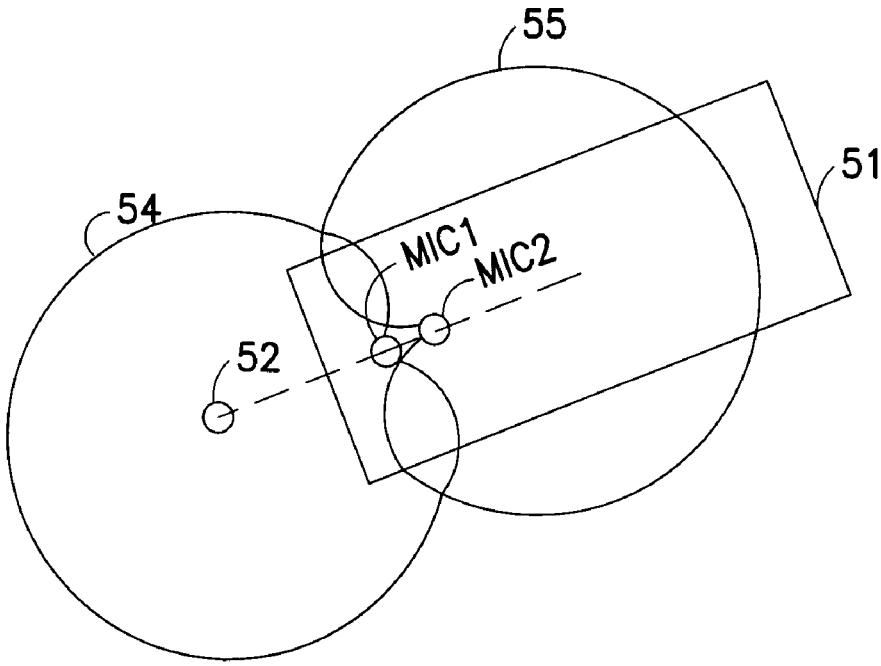
FIG. 5 is a diagram illustrating beam patterns used in the device shown in FIG. 1.

FIG. 5 illustrates a principle of main beams and anti beams in the context of mobile/wireless terminals where the two microphones and source 52 (for example, a user's mouth) are on a same line. In particular, the main beam and anti beam patterns may be on a line joining the two microphones. FIG. 5 shows a terminal 51 with microphone 1 (MIC1) and microphone 2 (MIC2) and the main beam 54 and anti beam 55 formed by the beam former 29 of FIG. 3. In one embodiment, the beams 54, 55 have opposite directions (about 180 degrees) and cardioid (K=½, in formula (1)) symmetrical shapes, but other design variations are possible. Embodiments of the invention are not limited to the use of two microphones. Having more than two microphones may allow for having, for example, several beams. Additionally, having more than two microphones may allow for having, for example, a narrower main beam instead of the main beam as shown in FIG. 5. However, any suitable number of microphones or beam (mainbeam or antibeam) patterns may be provided.

It should be noted that the spatial voice activity detector 6*b* in FIG. 2 may be any type of spatial voice activity detector. According to one example of the invention, the spatial voice activity detector may be provided as described in copending U.S. patent application Ser. No. 12/109,861 (titled "METHOD AND APPARATUS FOR VOICE ACTIVITY DETERMINATION"), filed on Apr. 25, 2008, which is hereby incorporated by reference in its entirety.

It should be noted that the second voice activity detector 6*c* in FIG. 1 may be any type of voice activity detector. 3GPP standard TS 26.094 (Mandatory speech codec speech processing functions; Adaptive Multi-Rate (AMR) speech codec; Voice Activity Detector (VAD)) provides one example implementation of the voice activity detector 6*b*. However, the spatial VAD 6*c* may be any suitable kind of VAD.

According to one embodiment of the invention, the classifier 6*c* may classify a speech frame as a noise frame (when spatial voice activity detector 6*b* classifies a frame as a noise frame and position detector 6*a* classifies optimal position).

According to various embodiments of the invention, directional microphones could be used instead of beams. In these example embodiments, a stereo beam former is not required, but the ratio signal powers from the directional microphones (primary—secondary microphone ratio) may be used as decision criteria in the position detector.

Suboptimal performance may be obtained without filtering. Such frequency bands where there is only a very small difference in signal levels between the two signals, interfere rather than improve detection.

According to various embodiments of the invention, it is also possible to use such positioning between microphones where a distance is so long/large that a ratio between signal powers could be used directly.

Various embodiments of the invention are directed to the field of digital signal processing, in speech enhancement. The intention in speech enhancement is to use mathematical methods for improving quality of speech, presented as digital signals. One embodiment of the invention considers speech enhancement and especially noise suppression in such situations where there are two or more noisy speech signals available, for example, from two microphones.

Figure 6:
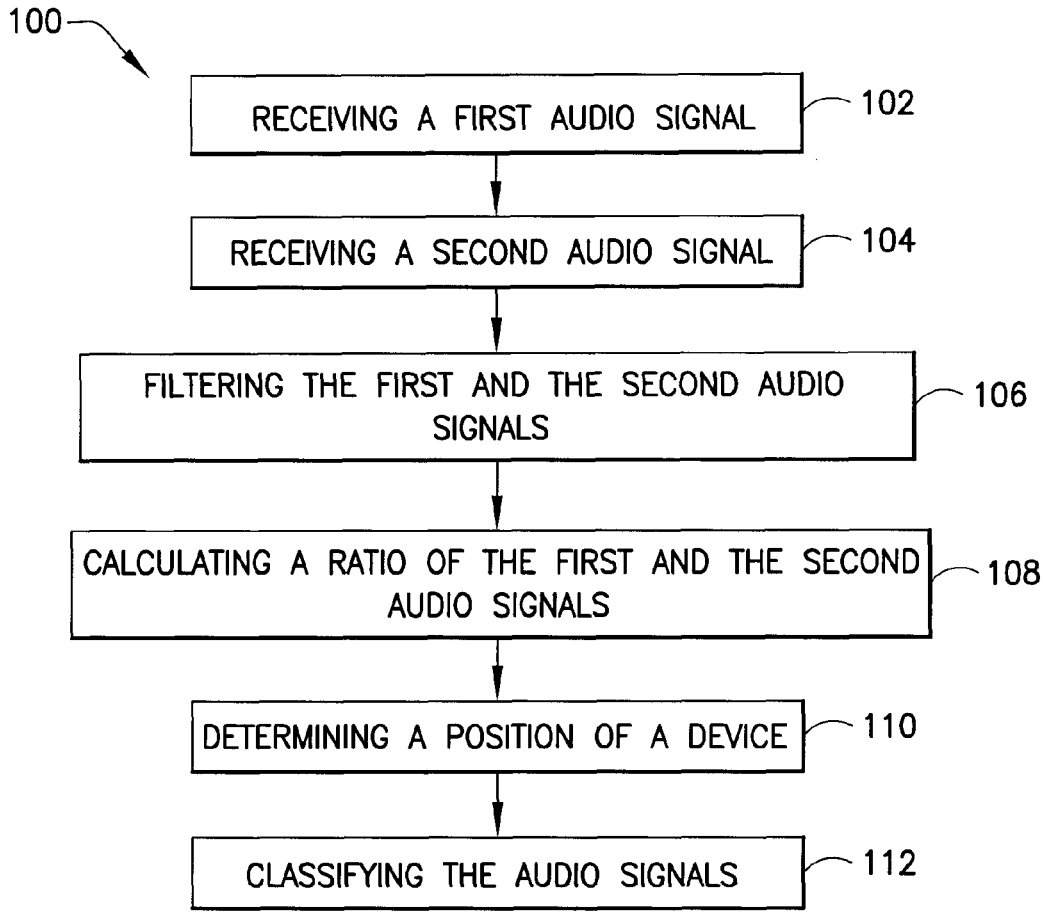
FIG. 6 is a block diagram of an exemplary method of the device shown in FIG. 1.

FIG. 6 illustrates a method 100. The method 100 includes the following steps. Receiving a first audio signal (step 102). Receiving a second audio signal (step 104). Filtering the first and the second audio signals (step 106). Calculating a ratio of the first and the second audio signals (step 108). Determining a position of a device (step 110). Classifying the audio signals based on the calculated ratio and the determined position of the device (step 112). It should be noted that any of the above steps may be performed alone or in combination with one or more of the steps.

Figure 7:
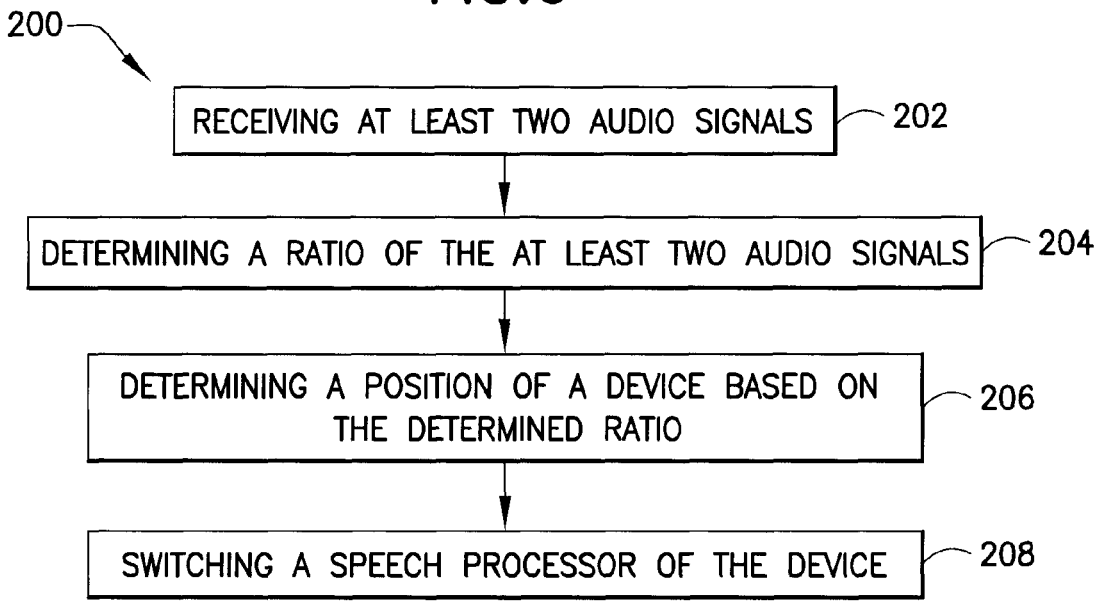
FIG. 7 is a block diagram of another exemplary method of the device shown in FIG. 1.

FIG. 7 illustrates a method 200. The method 200 includes the following steps. Receiving at least two audio signals. One of the at least two audio signals is received at a first microphone. Another one of the at least two audio signals is received at a second microphone (step 202). Determining a ratio of the at least two audio signals (step 204). Determining a position of a device based on the determined ratio (step 206). Switching a speech processor of the device from a two microphone processing mode to a one microphone processing mode based on, at least partially, the determined position of the device (step 208). It should be noted that any of the above steps may be performed alone or in combination with one or more of the steps.

Based on the foregoing, it should be apparent that the exemplary embodiments of this invention provide an apparatus, a method, and computer program product(s) to process an audio signal.

According to one example of the invention, an apparatus is disclosed. The apparatus includes a first audio input device, a second audio input device, an analog to digital converter, a voice activity detector, and a position detector. The first audio input device is configured to receive a first audio signal. The second audio input device is configured to receive a second audio signal. The analog to digital converter is connected to the first and the second audio input devices. The voice activity detector is connected to the analog to digital converter. The voice activity detector is configured to receive input from the first and the second audio input devices. The position detector is connected to the voice activity detector. The position detector is configured to determine a position of the apparatus and classify the audio signals based on, at least partially, a ratio of the first audio signal and the second audio signal.

According to another example of the invention, a program storage device readable by a machine, tangibly embodying a program of instructions executable by the machine for performing operations to process audio speech signals is disclosed. A first audio signal is received. A second audio signal is received. The first and the second audio signals are filtered. A ratio of the first and the second audio signals is calculated. A position of a portable device is determined. The audio signals are classified based on the calculated ratio and the determined position of the portable device.

It should be understood that components of the invention can be operationally coupled or connected and that any number or combination of intervening elements can exist (including no intervening elements). The connections can be direct or indirect and additionally there can merely be a functional relationship between components.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An apparatus comprising:

a first audio input device configured to receive a first audio signal;

a second audio input device configured to receive a second audio signal;

an analog to digital converter connected to the first and the second audio input devices;

a spatial voice activity detector connected to the analog to digital converter, wherein the spatial voice activity detector is configured to receive input from the first and the second audio input devices; and a position detector connected to the spatial voice activity detector, wherein the position detector is configured to determine a position of the apparatus and classify the audio signals based on, at least partially, a ratio of the first audio signal and the second audio signal.

2. An apparatus as in claim 1 wherein the spatial voice activity detector and the position detector form a portion of a speech processor of the apparatus.

3. An apparatus as in claim 1 wherein the position detection is configured to change values based on a predetermined ratio threshold.

4. An apparatus as in claim 1 wherein the apparatus is configured to determine between an optimal and off-axis position of the apparatus.

5. An apparatus as in claim 1 wherein the apparatus is configured to switch from two microphone speech processing to single microphone speech processing when the ratio is at a predetermined threshold.

6. An apparatus as in claim 1 wherein the apparatus further comprises a stereo beam former connected to the position detector.

7. An apparatus as in claim 6 wherein the stereo beam former is configured to receive the first and the second audio signals as input, and wherein the stereo beam former is configured to output corresponding mainbeam and antibeam signals.

8. An apparatus as in claim 7 wherein the ratio further comprises a ratio of the mainbeam and antibeam signals.

9. A device comprising:

a housing;

electronic circuitry in the housing; and an apparatus as in claim 1, wherein the apparatus is connected to the electronic circuitry.

10. A method comprising:

receiving a first audio signal; receiving a second audio signal;

filtering the first and the second audio signals;

calculating a ratio of the first and the second audio signals;

determining a position of a device; and classifying the audio signals based on the calculated ratio and the determined position of the device.

11. A method as in claim 10 wherein a position detector of the device is configured to output a binary value based on, at least partially, the calculated ratio.

12. A method as in claim 10 wherein the classifying further comprises classifying between a speech signal and a noise signal.

13. A method as in claim 10 wherein the calculating of the ratio further comprises calculating a ratio of a mainbeam signal and an antibeam signal.

14. A method comprising:

receiving at least two audio signals, wherein one of the at least two audio signals is received at a first microphone, and wherein another one of the at least two audio signals is received at a second microphone;

determining a ratio of the at least two audio signals;

determining a position of a device based on the determined ratio; and switching a speech processor of the device from a two microphone processing mode to a one microphone processing mode based on, at least partially, the determined position of the device.

15. A method as in claim 14 the speech processor is configured to classify the audio signals based on the determined ratio.

16. A method as in claim 14 further comprising estimating a background noise level.

17. A program storage device readable by a machine, tangibly embodying a program of instructions executable by the machine for performing operations to process audio speech signals, the operations comprising:

receiving a first audio signal;

receiving a second audio signal;

filtering the first and the second audio signals;

calculating a ratio of the first and the second audio signals;

determining a position of a portable device; and classifying the audio signals based on the calculated ratio and the determined position of the portable device.

18. A program storage device as in claim 17 further comprising switching from two microphone speech processing to one microphone speech processing when the ratio reaches a first predetermined threshold.

19. A program storage device as in claim 17 wherein the determining of the position further comprises determining between an optimal position and an off-axis position of the portable device.

* * * * *